US005086883A

United States Patent [19]

Schroder

[11] Patent Number: 5,086,883

[45] Date of Patent: Feb. 11, 1992

[54] GROUP CONTROL FOR ELEVATORS WITH DOUBLE CARS WITH IMMEDIATE ALLOCATION OF TARGET CALLS

[75] Inventor: Joris Schroder, deceased, late of Luzern, Switzerland, by Margrit Meyer, executor

[73] Assignee: Inventio AG, Switzerland

[21] Appl. No.: 708,445

[22] Filed: May 31, 1991

[30] Foreign Application Priority Data

Jun. 1, 1990 [CH] Switzerland ..... 01863/90

[51] Int. Cl.[5] ..... B66B 1/18

[52] U.S. Cl. ..... 187/127; 187/121

[58] Field of Search ..... 187/127, 121, 57, 125

[56] References Cited

U.S. PATENT DOCUMENTS 4,632,224 12/1986 Novak et al. ..... 187/127
4,836,336 6/1989 Schroder ..... 187/121
4,993,518 2/1991 Straaten et al. ..... 187/127

*Primary Examiner*—A. D. Pellinen
*Assistant Examiner*—Lawrence E. Colbert
*Attorney, Agent, or Firm*—William J. Clemens

[57] ABSTRACT

A group control for double car elevators permits the upper as well as the lower cars to be used at a main stopping floor for travel to both even-numbered and odd-numbered floors. The control has a call memory for each car in which the target calls entered at the main stopping floor and identifying the target floors are stored. A switching circuit has an input connected to the call memories in such a manner that the double car is scheduled in dependence on the allocated call as stopping at floor pairs numbered even-odd or odd-even. An output of the switching circuit is connected to a switching device which excludes either the double cars stopping at floor pairs numbered even-odd or at floor pairs numbered odd-even from the allocation process in the case of a subsequent call to be allocated in order to maximize the possiblilities for coincident stops without losing flexibility.

10 Claims, 2 Drawing Sheets

GROUP CONTROL FOR ELEVATORS WITH DOUBLE CARS WITH IMMEDIATE ALLOCATION OF TARGET CALLS

BACKGROUND OF THE INVENTION

The present invention relates generally to an elevator system and, in particular, to a group control for elevators with double cars for the immediate allocation of target calls.

A control for an elevator group with double cars is shown in the Swiss patent document CH-PS 529 054 in which the double cars are constructed in such a manner that two adjacent floors can be served at the same time. In this case, the filling of a building can be achieved in the shortest possible time with approximately uniform occupation of the double cars. The passengers traveling to even-numbered upper floors board the upper car and those traveling to the odd-numbered upper floors board the lower car on the ground floor, wherein the car call transmitters are blocked each time for the floors not associated with the car. After departure from the ground floor, as soon as the car stops in response to a floor call, the blocking is canceled so that the boarding passenger can travel to any desired floor.

Elevators of the above-described kind can convey twice as many passengers during each trip as elevators with single cars. Since less stopping has to be done, the same number of floors can be served in a shorter time so that the conveying performance is increased appreciably. However, it can occur with this control that passengers, who do not observe the division of the even-numbered and the odd-numbered floors over the upper and lower cars respectively, do not reach the desired floor and must alight at a different one. It must also be regarded as disadvantageous that the constraint to use the right car, which is exerted on the boarding passengers at the main stopping floor, exists not only during the relatively short time of the peak traffic, but also during the remaining time.

Another control, which is shown in the European patent document EP-A 0 301 178, is used for elevators with single or double cars and has call registering devices with keys for the entry of calls for desired target floors located on the floors and no call buttons are provided in the elevator cars. At the main stopping floor, call registering devices with keys for even-numbered target floors are located at the access for the upper cars of the double cars while the access for the lower cars of the double cars has located there call registering devices with keys for odd-numbered target floors. It is proposed in a further example of the embodiment to use call registering devices with decade keyboards, wherein the keys for the odd-numbered target floors at the upper access and the keys for the even-numbered target floors at the lower access are made ineffective. Even in the case of this control equipment, a passenger must consider exactly which access he has to use in order to reach the desired travel target. On use of a wrong access, however, the error can still be noticed before boarding the car so that the correct travel target can be reached through a change to the proper access.

A group control for single cars is shown in the European patent document EP-A 0 356 731 which applies the shortest waiting time of all passengers as the criterion for the allocation of the cars to the entered calls. In this control, the travel targets can likewise be entered at the floors by the call registering and indicating devices shown in the European patent document EP-A 0 320 583. Immediately after the registration and transfer of a call into a call memory divided according to input and target floors, a computer in the form of a microprocessor computes a sum called operating costs for each car from data specific to the elevator, which sum corresponds to the waiting time which would arise for the passengers in the serving of the call. The operating costs are transferred immediately after the computation into a costs register and subsequently immediately compared with the operating costs of the other elevators by means of a comparison device. In this case, an allocation instruction is stored in an allocation memory of that car which has the lowest operating costs. Immediately after the allocation of a car to the call has taken place in this manner, the elevator concerned and its position are indicated in an indicating field of the actuated call registering and indicating device so that the passenger can move in good time to the associated shaft door.

SUMMARY OF THE INVENTION

The present invention is based on the task of improving the prior art elevator group control equipment in such a manner that, in the case of elevators with double cars, the upper as well as the lower cars of the double cars can be used at the main stopping floor for travels to even-numbered and odd-numbered floors.

The invention concerns a group control with double cars with the immediate allocation of target calls, wherein the double cars are formed of two cars which are arranged in a common car frame and can be boarded selectively at a main stopping floor. The control has call registering devices which are located on the floors and have a keyboard for the entry of calls of desired target floors. The control also has call memories which are associated with the elevators and connected with the call registering devices wherein a call identifying the input floor and a call identifying the target floor are stored on the entry of a call. Load-measuring devices are provided in the upper car and the lower car of the double car and stand in operative connection with load memories. Selectors are provided each designating the floor of a possible stop.

The control further includes a call memory in which the calls entered at the main stopping floor and identifying the target floors are stored. The call memory is associated with the upper car and with the lower car of a double car. A switching circuit has an input connected with the call memories in such a manner that the double car concerned is scheduled for stopping at floor pairs numbered even-odd or odd-even in dependence on an allocated call. At an output, the switching circuit is connected by way of a switching device with a comparison device so that, in dependence on a future still to be allocated call, either the double cars stopping at the floor pairs numbered even-odd or the double cars stopping at floor pairs numbered odd-even can not participate in the comparison and allocation process. A call is allocated immediately after the entry thereof, wherein the elevator concerned and its position are indicated on an indicating field of the actuated call registering device.

The advantages achieved by the present invention are that the passengers at a main stopping floor no longer need to consider whether they have to board the upper car or the lower car of a double car in order to reach a desired floor since the control can position a suitable car at the upper as well as also at the lower access. In this case, the initially mentioned advantage, that double car elevators have to stop less often for trips from the main stopping floor than single car elevators, remains fully maintained. The preference for coincident stops is also furthermore possible, wherein the possibility of stopping odd-even or even-odd during the same round trip improves the availability of the cars and shortens the waiting times.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
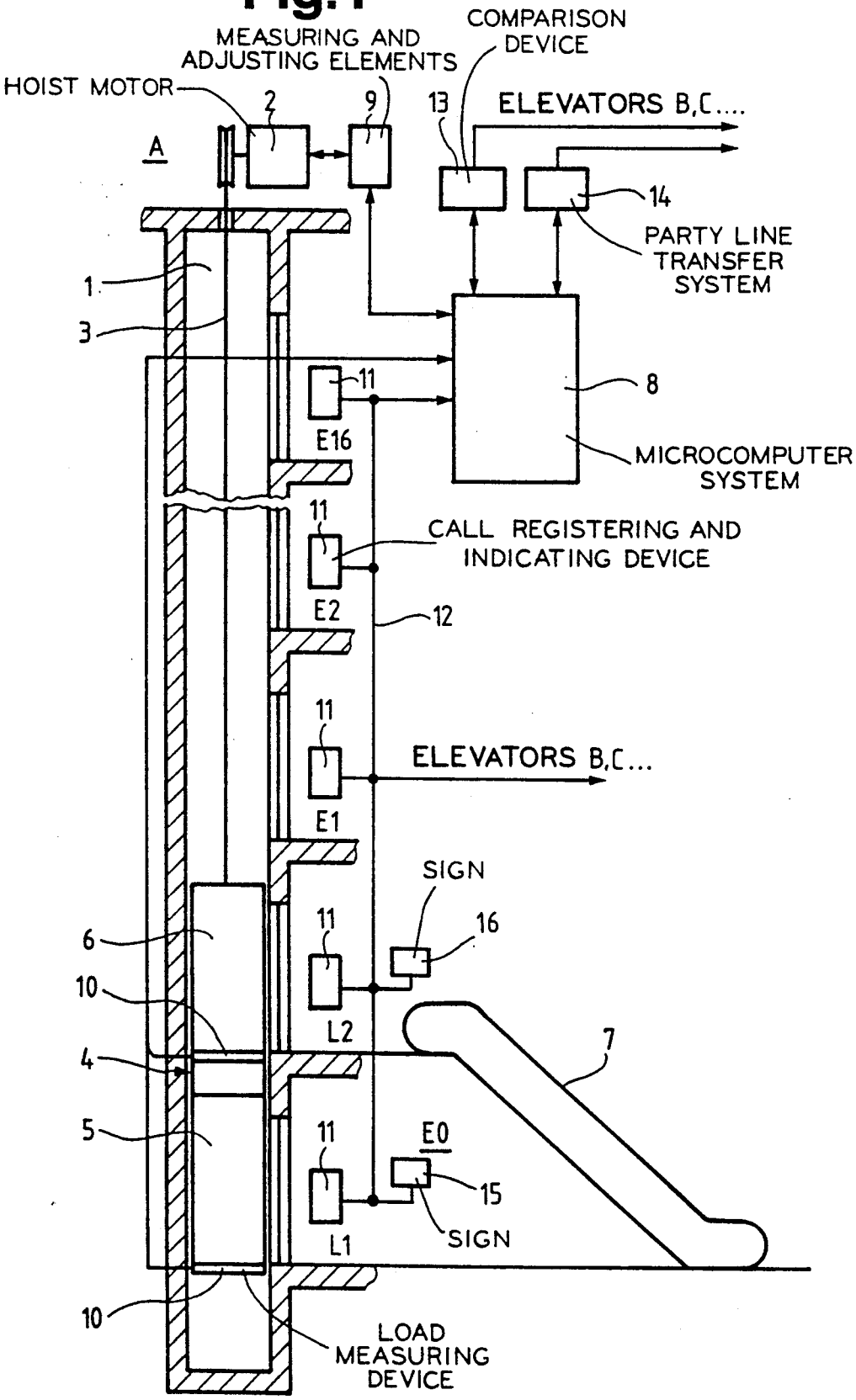
FIG. 1 is a schematic view of the group control, according to the invention, for an elevator of an elevator group with double cars.

Shown in the FIG. 1 is an elevator shaft 1 for an elevator A of an elevator group having several elevators such as elevators B and C. A hoist motor 2 drives a double car 4, which is guided in the elevator shaft 1 and has two cars 5 and 6 arranged in a common car frame, by way of a hoist cable 3. The double car 4 serves sixteen floors E1 through E16 in a building, for example. The spacing of the cars from each other is chosen so that it coincides with the spacing between two adjacent floors. A main stopping floor E0, such as a lobby provided for example on the ground floor, has a lower access L1 to the lower car 5 and an upper access L2 to the upper car 6 of the double car 4, wherein the upper access L2 is connected by an escalator 7 with the lower access L1.

The hoist motor 2 is controlled by a drive control, such as the drive control shown in the European patent document EP-B 0 026 406, wherein the target value generation, the regulating function and the stop initiation are realized by means of a microcomputer system 8 which is connected with measuring and adjusting elements 9 of the drive control. The microcomputer system 8 computes, as is for example shown in the European patent document EP-A 0 356 731, a sum from data specific to the elevator. This sum is also called the operating costs and corresponds to the waiting time of all passengers to form the basis of the call allocation procedure. The cars 5 and 6 include load measuring devices 10 which are connected to the microcomputer system 8. Call registering and indicating devices 11, which are for example shown in the European patent document EP-A 0 320 583, are provided on the floors and have decade keyboards by means of which calls can be entered for trips to desired target floors.

The call registering and indicating devices 11 are connected by serial interface blocks (not shown) and a serial data conductor 12 with the microcomputer systems 8 of each of the elevator cars. The microcomputer systems 8 of the individual elevators of the group are connected together by a comparison device 13 shown in the European patent document EP-B 0 050 304 and a party line transfer system 14 shown in the European patent document EP-B 0 050 305.

Figure 2:
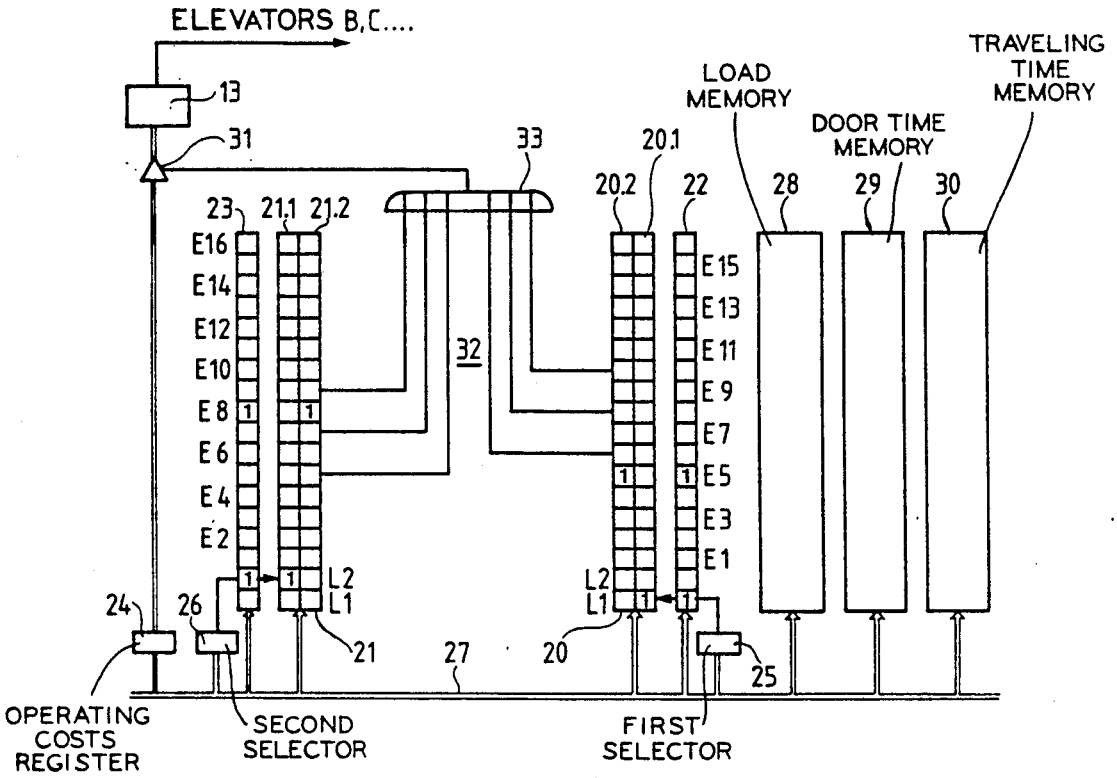
FIG. 2 is a schematic illustration of a portion of the group control shown in the FIG. 1.

The FIG. 2 shows schematically a portion of the microcomputer system 8 associated with the elevator A having a pair of call memories 20 and 21. The memories 20 and 21 are associated respectively with a pair of call allocation memories 22 and 23, for the lower car 5 and the upper car 6 respectively of the double car 4. The call memories 20 and 21 and the allocation memories 22 and 23 have storage locations corresponding to the number of the floors for each direction of travel. However, merely the memory locations associated with the upward direction of travel are illustrated in the FIG. 2. The call memories 20 and 21 each consist of a respective first memory portion 20.1 and 21.1 and a respective second memory portion 20.2 and 21.2, wherein the calls identifying the call input floors are stored in the first memory locations of the portions 20.1 and 21.1 and the calls identifying the target floors are stored in the second memory locations of the portions 20.2 and 21.2.

An operating costs register 24 stores the operating costs. A first selector 25, associated with the lower car 5, and a second selector 26, associated with the upper car 6, each form addresses which correspond to the floor numbers and by means of which the storage locations of the memories 20 and 21 can be addressed. The selectors 25 and 26 are registers which indicate that floor at which the double car 4 could still stop either for the lower car 5 or the upper car 6. For that purpose, the second selector 26 leads the first by one floor during the upward travel of the double car 4 and the first selector 25 leads the second by one floor during the downward travel. The call memories 20 and 21 and the allocation memories 22 and 23 are read-write memories which are connected, as are the registers 24, 25 and 26, with a bus 27 of the microcomputer system 8. The calls which are stored in the call memories 20 and 21 and the allocation instructions which are stored in the allocation memories 22 and 23 are characterized symbolically by "1", wherein the allocation instructions denote that the call pair L1/E5 are allocated to the lower car 5 and the call pair L2/E8 are allocated to the upper car 6 of the double car 4 of the elevator A.

A load memory 28, a door time memory 29 and a traveling time memory 30 are likewise connected to the bus 27 of the microcomputer system 8. The memories 28, 29 and 30, which are shown in the above cited European patent document EP-A 0 356 731, are read-write memories in which data are stored for the operating costs computation. Load values, in the form of a number of persons who are situated in the respective lower car 5 or the upper car 6 on a future stop or the travel past a floor and which can be calculated by reason of the entered calls, are stored for each floor in the load memory 28. In this case, load values formed from faulty call entries can be corrected by comparison with values ascertained through the load measuring devices 10.

The door opening and closing times of the associated elevator are stored for each floor in the door time memory 29, while the traveling times of the double car 4 between a certain floor and every other floor are stored in the traveling time memory 30. The operating costs register 24 is connected to the comparison device 13 by a switching device 31 in the form of tristate buffers wherein the activating connections of the tristate buffers are connected to the output of a switching circuit 32. The switching circuit 32 consists of an OR-gate 33 which has six inputs each associated with six successive floors. In a first embodiment according to the FIG. 2, three of the inputs are each respectively connected with outputs of those storage locations of the second memory 21.2 of the upper car 6 which are associated with the odd-numbered floors, and the other three inputs are each connected to the outputs of those storage locations of the second memory 20.2 of the lower car 5 which are associated with the even-numbered floors. In a second embodiment, as illustrated in the FIG. 3, three of the inputs of the OR-gate 33 are each connected with respective outputs of those storage locations of the second memory 21.2 of the upper car 6 which are associated with the even-numbered floors, and the other three inputs are each connected to the respective outputs of those storage locations of the second memory 20.2 of the lower car 5 which are associated with the odd-numbered floors.

The output of the OR-gate 33 is connected to the activating inputs of the tristate buffers 31. The switching circuit 32, which is for example formed by the microcomputer system 8 in accordance with a computer program, is activated each time on the storage of a call to be allocated. In this case, in dependence on the target floor concerned and on the memory into which the call was transferred, either the connections according to the first or the second embodiment are generated in such a manner that the target floor is associated with the middle one of the three floor pairs connected through the switching circuit 32.

Figure 4:
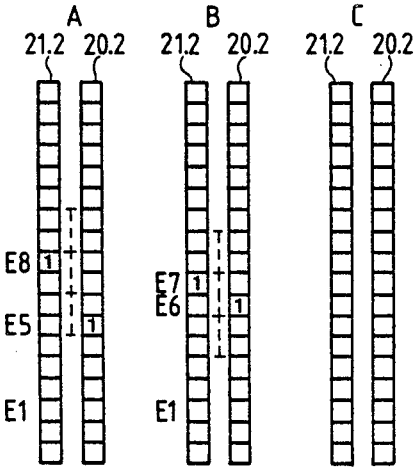
FIG. 4 is a schematic illustration of the call memories associated three elevators of the elevator group with double cars shown in the FIG. 1.

Only the second memories 20.2 and 21.2 of the lower car 5 and the upper car 6, respectively, of the double car 4 are illustrated in the FIG. 4 for the three elevators A, B and C of an elevator group. The distribution of the target calls, which are entered at either the lower access L1 or the upper access L2 (FIG. 1) and characterized by "1", over the second memories 20.2 and 21.2 is explained more closely in the following functional description with the aid of an example. In this case, in the range of three respectively adjacent floor pairs, the double car 4 of the elevator A is scheduled to stop at floor pairs numbered even-odd and the double car 4 of the elevator B is scheduled to stop at floor pairs numbered odd-even, while the double car 4 of the elevator C is not yet scheduled.

The above-described group control operates as follows: Upon the entry of a hall call, the address of the call input floor and the address of the target floor are transferred on the serial data conductor 12 into the microcomputer systems 8 of all of the elevators, whereupon only one of the call registering and indicating devices 11 can have access to the serial data conductor 12 at a time. If the call is entered on the lower access L1 or the upper access L2 of the main stopping floor E0, the individual microprocessors of the microcomputer systems 8 operate the address of the call entry memory in such a manner that the call pair concerned is entered into the call memories of either only the upper or only the lower cars (for example, in the FIG. 2, the call pair L2/E8). It is assumed, for example, that calls for the floors E8 and E7 were entered at the upper access L2 and calls for the floors E5 and E6 were entered at the lower access L1. It is furthermore assumed that the switching device 31 passes signals in response to a logic "0" at the output of the switching circuit 32.

After the entry of the call for the floor E8 at the upper access L2, the call is transferred into the call memories 21 associated with the upper cars 6 of all of the elevators for which the switching circuit 32 according to the first embodiment of FIG. 2 is activated. Since the output of the storage location associated with the floor E8 is not connected with an input of the OR-gate 33 and no call may yet be stored for the floors E5 to E8 in the call memories 20 and 21 of all of the elevators, the switching device 31 remains in the conductive state so that all elevators can participate in the comparison. Now, the operating costs for the new call pair are computed for all of the elevators according to the disclosure in the above-identified European patent document EP-A 0 356 731. Immediately after the computation, the operating costs are transferred into the operating costs registers 24 for each of the cars and compared one with the other by means of the comparison device 13, for example, as shown in the above-identified European patent document EP-B 0 050 304.

If it is assumed that the elevator A displays the lowest operating costs so that an allocation instruction is entered into its allocation memory 23 at the floors L2 and E8 (FIG. 2). Thereafter, the new call pair is canceled for the elevators without the allocation instruction. By the allocation of the call for floor E8, the double car 4 of the elevator A is scheduled to stop in the region of three adjacent floor pairs numbered even-odd with the upper car 6 at even-numbered floors.

Figure 3:
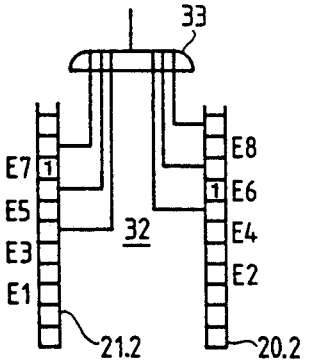
FIG. 3 is a schematic illustration of an alternate embodiment of a switching circuit in the portion of the group control shown in the FIG. 2.

Upon the entry of the call for the floor E7 at the upper access L2 and after the transfer of the call into the call memories 21 associated with the upper cars 6 of all of the elevators, the output of the OR-gate 33 for elevator A (FIG. 2) becomes logic "1" so that the switching device 31 blocks signals and the elevator A can not participate in the allocation process. For the remaining elevators, the switching circuit 32 is activated according to the second embodiment shown in the FIG. 3 for which the switching device 31 is not blocked. In the following allocation process, the call for the floor E7 may be allocated to the elevator B (FIG. 3) so that the double car 4 of this elevator is scheduled to stop in the region of three adjacent floor pairs numbered odd-even with the upper car 6 at odd-numbered floors. If the call for the floor E5 is now entered at the lower access L1, then the elevator B can no longer participate in the allocation procedure while the call is, for example, allocated to the elevator A (FIG. 2). The call for floor E6 likewise entered at the lower access L1 has the effect that the elevator A is excluded from the allocation. This call may, for example, be allocated to the elevator B (FIG. 3).

Immediately after a call allocation, the allocated call and its position are indicated to the passenger in an indicating field of the actuated call registering and indicating device 11. If a target call for a floor pair is stored either only for the lower car or only for the upper car of a double car, the first selector 25 becomes effective in the first case for the stop initiation and the second selector 26 becomes effective in the second case for the stop initiation (FIG. 4, elevator A, floor pairs E5/E6 and E7/E8).

In order to ensure that the lower car 5 and the upper car 6 are filled evenly during the peak traffic on boarding at the main stopping floor E0, optical indicating devices can be provided which, in dependence on the already allocated target calls, signal the more advantageous cars to the newly arriving passengers. Thus, for example, signs, on which it is indicated whether certain target floors can be reached more quickly by the use of the lower cars 5 or the upper cars 6, can be located at the accesses, such as a sign 15 at the access L1 and a sign 16 at the access L2 as shown in the FIG. 1.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A group control for elevators with the immediate allocation of target calls to double cars having two cars which are arranged in a common car frame and can be boarded selectively at a main stopping floor, call registering devices which are located at the floors and have a keyboard for the entry of calls for desired target floors, call memories which are associated with the elevators and connected with the call registering devices wherein a call identifying the input floor and a call identifying the target floor are stored on the entry of a call, load measuring devices which are provided in the lower car and in the upper car of the double car and are connected with load memories, selectors for designating the floor of a possible stop, and a call allocation device for allocating the entered calls to the elevators, wherein the call allocation device for each elevator has a computer which computes operating costs corresponding to the waiting times of passengers from data specific to the elevator, an operating costs register connected to the computer wherein the operating costs registers of all of the elevators are connected to a comparison device which compares the operating costs of the elevators one with the other such that the entered call is allocated to that elevator which displays the lowest operating costs, comprising:

a call memory for each car of a double car in an elevator group serving a plurality of floors, each said call memory having first memory locations for storing a call representing a call input floor and second memory locations for storing a call representing a call target floor in response to an entered call;

a switching circuit having an input connected to said second memory locations such that the double car to which said entered call is allocated is scheduled in dependence on said allocated call for stopping at floor pairs numbered odd-even or even-odd;

a switching device connected for actuation to an output of said switching circuit and connected between an operating costs register and a comparison device so that either the double cars stopping at floor pairs numbered even-odd or the double cars stopping at floor pairs numbered odd-even can not participate in a comparison and allocation process for the allocation of a subsequently entered call; and call registering and indicating devices located at floors served by the double cars of the elevator group for entering a target call upon actuation and for indicating the car to which said target call is allocated and the position of the car on an indicating field of the actuated one of said call registering and indicating devices.

2. The group control according to claim 1 wherein said switching circuit schedules the double car only for three directly adjacent floor pairs wherein said allocated call is associated with the middle one of the three floor pairs.

3. The group control according to claim 2 wherein the double cars have an upper car and a lower car and said switching circuit includes an OR-gate having six inputs each associated with a respective one of six successive floors, three of said inputs being connected with outputs of said storage locations of said second memory of the upper car which are associated with the odd-numbered floors and the other three of said inputs being connected with outputs of said storage locations of said second memory of the lower car which are associated with the even-numbered floors, and having an output connected to an activating input of said switching device, said switching device including tristate buffers.

4. The group control according to claim 2 wherein the double cars have an upper car and a lower car and said switching circuit includes an OR-gate having six inputs each associated with a respective one of six successive floors, three of said inputs being connected to outputs of said storage locations of said second memory of the upper car which are associated with the even-numbered floors and the other three of said inputs being connected to outputs of said storage locations of said second memory of the lower car which are associated with the odd-numbered floors, and having an output connected to an activating input of said switching device, said switching device including tristate buffers.

5. The group control according to claim 1 including a first selector associated with the lower car and a second selector associated with the upper car, wherein said first selector scans said call memory of the lower car and said second selector scans said call memory of the upper car and said second selector leads said first selector by one floor during the upward travel direction of the cars and said first selector leads said second selector by one floor during the downward travel direction of the cars.

6. The group control according to claim 1 including optical indicating devices located at a main stopping floor for indicating to passengers that the lower cars or the upper cars are or are not recommended for use to certain target floors in response to one or more of said allocated target calls.

7. A group control for elevators with the immediate allocation of target calls to double cars comprising:

at least two double car elevators each having two cars which are arranged in a common car frame and can be boarded selectively at a main stopping floor for travel to a plurality of floors;

call registering devices located at the floors served by said elevators and having a keyboard for the entry of target calls for desired target floors;

a call memory for each said car of said elevator, each said call memory having first memory locations for storing a call representing a call input floor and second memory locations for storing a call representing a call target floor in response to an entered target call;

a call allocation device for allocating said entered target call to said elevators including a computer for each said elevator for computing operating costs corresponding to the waiting times of passengers from data specific to said elevator, an operating costs register connected to said computer and a common comparison device wherein said operating costs registers of all of said elevators are connected to said comparison device which compares the operating costs of said elevators one with the other such that said entered target call is allocated to the one of said elevators which displays the lowest operating costs;

a switching circuit for each said elevator having an input connected to said second memory locations such that said elevator to which said entered target call is allocated is scheduled in dependence on said allocated call for stopping at floor pairs numbered odd-even or even-odd;

a switching device for each said connected for activation to an output of said switching circuit and connected between said operating costs register and said comparison device so that either said elevators stopping at floor pairs numbered even-odd or said elevators stopping at floor pairs numbered odd-even can not participate in a comparison and allocation process for the allocation of a subsequently entered target call; and call registering and indicating devices located at floors served by said elevators for entering a target call upon actuation and for indicating the car to which said target call is allocated and the position of the car on an indicating field of the actuated one of said call registering and indicating devices.

8. The group control according to claim 7 wherein said switching circuit schedules said elevator only for three directly adjacent floor pairs wherein said allocated call is associated with the middle one of the three floor pairs.

9. A group control for elevators with the immediate allocation of target calls to double cars having two cars which are arranged in a common car frame and can be boarded selectively at a main stopping floor, call registering devices which are located at the floors and have a keyboard for the entry of calls for desired target floors, call memories which are associated with the elevators and connected with the call registering devices wherein a call identifying the input floor and a call identifying the target floor are stored on the entry of a call, load measuring devices which are provided in the lower car and in the upper car of the double car and are connected with load memories, selectors for designating the floor of a possible stop, and a call allocation device for allocating the entered calls to the elevators, wherein the call allocation device for each elevator has a computer which computes operating costs corresponding to the waiting times of passengers from data specific to the elevator, an operating costs register connected to the computer wherein the operating costs registers of all of the elevators are connected to a comparison device which compares the operating costs of the elevators one with the other such that the entered call is allocated to that elevator which displays the lowest operating costs, comprising:

a call memory for each of a lower car and an upper car of a double car in an elevator group serving a plurality of floors, each said call memory having first memory locations for storing a call representing a call input floor and second memory locations for storing a call representing a call target floor in response to an entered call;

a switching circuit having an input connected to said second memory locations such that the double car to which said entered call is allocated is scheduled in dependence on said allocated call for stopping at floor pairs numbered odd-even or even-odd only for three directly adjacent floor pairs wherein said allocated call is associated with the middle one of the three floor pairs;

a switching device connected for actuation to an output of said switching circuit and connected between an operating costs register and a comparison device so that either the double cars stopping at floor pairs numbered even-odd or the double cars stopping at floor pairs numbered odd-even can not participate in a comparison and allocation process for the allocation of a subsequently entered call; and call registering and indicating devices located at floors served by the double cars of the elevator group for entering a target call upon actuation and for indicating the car to which said target call is allocated and the position of the car on an indicating field of the actuated one of said call registering and indicating devices.

10. The group control according to claim 9 wherein said switching circuit includes an OR-gate having six inputs each associated with a respective one of six successive floors, three of said inputs being connected with outputs of said storage locations of said second memory of the upper car which are associated with one of the odd-numbered floors and the even-numbered floors and the other three of said inputs being connected with outputs of said storage locations of said second memory of the lower car which are associated with the other one of the odd-numbered floors and the even-numbered floors, and having an output connected to an activating input of said switching device.

* * * * *